United States Patent [19]

Etherington et al.

[11] 3,977,654

[45] Aug. 31, 1976

[54] STANCHION

[75] Inventors: Geoffrey Etherington, Madison; David Berggren, Old Lyme, both of Conn.

[73] Assignee: Marine Fashion Inc., East Lyme, Conn.

[22] Filed: Aug. 25, 1975

[21] Appl. No.: 607,661

[52] U.S. Cl. ..... 256/59; 138/96 R; 256/1

[51] Int. Cl.[2] ..... B01F 13/00

[58] Field of Search ..... 256/59, 10, 19, 50; 52/727, 615; 138/96 R, 96 T

[56] References Cited

UNITED STATES PATENTS

| | | | |
|---|---|---|---|
| 2,545,845 | 3/1951 | Du Batto et al. | 256/19 |
| 2,976,346 | 3/1961 | Bellamy | 256/19 |
| 3,557,512 | 1/1971 | Braeuninger et al. | 52/615 |

*Primary Examiner*—Thomas F. Callaghan
*Assistant Examiner*—Doris L. Troutman
*Attorney, Agent, or Firm*—Harold L. Stults

[57] ABSTRACT

A stanchion construction for boats having a thin walled stainless steel tube which is reinforced throughout the lower portion by a solid plastic cylinder. Horizontal forces exerted on the stanchion directly or through a lifeline, create very substantial stresses in the lower portion of the stanchion. The plastic cylinder surrounded tightly by the tube wall creates a very sturdy construction which is compact and light in weight.

3 Claims, 2 Drawing Figures

STANCHION

This invention relates to stanchions of the type used on boats particularly for supporting a lifeline.

An object of this invention is to devise an improved stanchion construction which is light in weight, inexpensive to manufacture, and dependable in use. A further object is to provide a stanchion and lifeline construction which will be free of difficulties encountered with similar constructions in the past. These and other objects will be in part obvious and in part pointed out below.

Stanchion and lifeline constructions are provided around the area of boat decks which are normally occupied by passengers. The purpose is to prevent accidental slipping and to assure proper safety at all times. It is normal practice to support each stanchion upon a mounting bracket and to then thread a lifeline through a fixed ring or an eye in the top of the stanchion. When a person exerts force on the stanchion or the lifeline, there is substantial leverage which creates a maximum bending force at the supporting bracket. Therefore, the stanchions are normally of relatively heavy gage steel. However, in accordance with the present invention, the stanchions are formed by relatively light gage stainless steel tubing.

Referring to the drawings.

Figure 1:
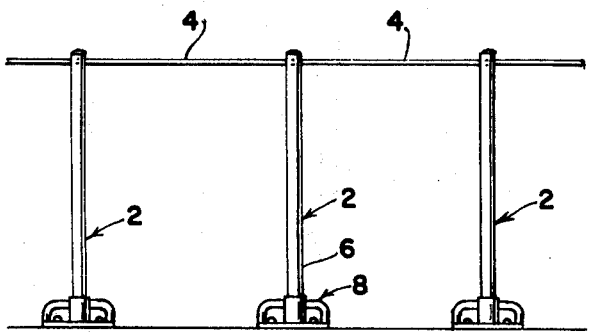
FIG. 1 is a perspective view of one embodiment of the invention.

Referring to FIG. 1 of the drawing, stanchions 2 cooperate to support a lifeline 4 along the edge of the passenger area of a boat. Each stanchion is formed by a stainless steel tube 6 mounted at its bottom end in a bracket 8 and rigidly attached thereto. The bracket in turn is rigidly mounted on the boat deck by heavy screws or bolts.

Figure 2:
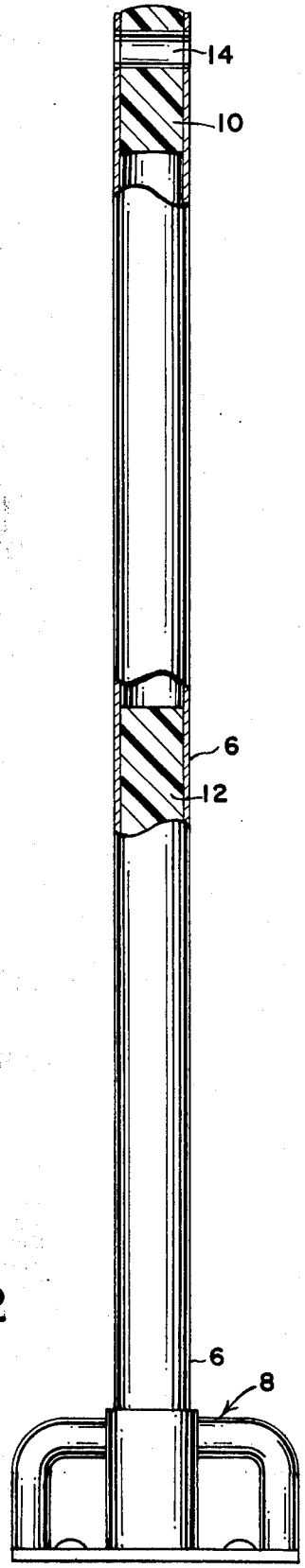
FIG. 2 is a side elevation of the stanchion of FIG. 1, with parts broken away.

Referring to FIG. 2, tube 6 is of relatively thin gage stainless steel, and tightly pressed into its ends are two cylindrical plastic cores — core 10 at the top and core 12 at the bottom. Core 10 has a convex or rounded top which projects from tube 6 and provides the top of the stanchion. As shown best in FIG. 2, the tube end and core 10 have a bore 14 to form a cylindrical hole for lifeline 4. Core 12 extends from the bottom end of tube 6 to a point above the mid-point of the length of tube 6. That is, the length of core 12 is one inch more than one-half the length of the tube. Cores 10 and 12 fit very tightly into the tube and are inserted by hydraulic pressure. The cores are snugly held and form with the tube a very sturdy compact construction.

When a horizontal force is exerted on the stanchion, it produces a bending moment adjacent the base and up along the stanchion. The stanchion acts as a lever tending to turn the base about an axis adjacent the boat deck. Core 12 and the surrounding portion of tube 6 resist the bending of the stanchion even when substantial horizontal force is exerted on the top of the stanchion. The core prevents the tube from deviating from its true cylindrical condition, and has very substantial compressive strength because of the hoop strength of the tube, and the tube also provides tension strength longitudinally of the stanchion.

The hollow portion of the tube between the cores provides a measure of resiliency in that the tube can bend slightly. However, the leverage effect between the top of the stanchion and the point in the tube directly above the top of core 12 is not sufficient to deform the tube under normal operating conditions. However, even if tube 6 is bent somewhat in the zone above core 12, the stanchion remains intact otherwise and still continues to cooperate with the other stanchions in holding the lifeline.

Under some circumstances it is desirable to provide a second lifeline near the upper end of core 12, and the stanchions may be provided with bores similar to bores 14 at that level.

It is understood that modifications may be made in the construction of the illustrative embodiment within the scope of the claims.

We claim:

1. A stanchion for mounting as one of a series on the surface of a boat deck or the like to cooperate for supporting a lifeline comprising, the combination of, a thin walled metal cylindrical tube of uniform internal diameter, a mounting bracket attached to the bottom end of said tube and adapted to be mounted upon said surface and to support said tube in a substantially vertical position, a solid cylinder of plastic which has been inserted into said tube from the bottom end thereof whereby said tube exerts hoop strength on said cylinder, said tube extending from the bottom end of said tube to beyond the center thereof, the diameter of said cylinder being such that it is snugly received within said tube and cooperates therewith to form a rigid construction whereby said solid cylinder prevents said tube from deviating from its true cylindrical condition and said tube provides tension strength longitudinally of the stanchion while exerting hoop strength around said solid cylinder, and a second cylinder of plastic of substantially the diameter of said first named cylinder and positioned within said tube at the top end thereof, said second cylinder having an end portion projecting from the end of said tube and presenting a convex end surface for the stanchion, said tube and said second cylinder having a diametric bore therethrough for the lifeline, said stanchion being strengthened by said rigid construction to withstand substantial bending stresses throughout the zone where such stresses are caused by horizontal forces on the stanchion and the lifeline.

2. A stanchion and lifeline cable construction comprising a plurality of stanchions as described in claim 1 mounted in substantially vertical parallel relationship, and a lifeline extending through said bores of said stanchions in series.

3. A stanchion and lifeline cable construction as described in claim 2 wherein each of said stanchions has a hollow portion above the upper end of said first named cylinder.

* * * * *